US006270369B1

(12) United States Patent
Kato et al.

(10) Patent No.: US 6,270,369 B1
(45) Date of Patent: Aug. 7, 2001

(54) SUB-CARD BOARD CONNECTOR, SUB-CARD BOARD, MODEM SUB-CARD, AND A COMPUTER HAVING THIS CONNECTOR

(75) Inventors: Katsutoshi Kato, Tokyo-to; Kazuo Fujii; Tetsuya Ohtani, both of Yokohama; Shigeki Mori, Machida, all of (JP); Thomas Studwell, Chapel Hill, NC (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/544,244

(22) Filed: Apr. 5, 2000

(30) Foreign Application Priority Data

Apr. 15, 1999 (JP) ..... 11-108136

(51) Int. Cl.[7] ..... H01R 13/62
(52) U.S. Cl. ..... 439/326; 439/924.1
(58) Field of Search ..... 439/326, 60, 924.1, 439/66, 862, 331, 733.1, 76.1

(56) References Cited

U.S. PATENT DOCUMENTS 3,701,071 * 10/1972 Landman ..... 439/326
4,503,608 * 3/1985 Evans ..... 439/326
4,602,351 * 7/1986 Shimamura ..... 439/326
4,713,013 * 12/1987 Regnier et al. ..... 439/326
4,767,341 * 8/1988 Lund ..... 439/60
5,302,136 * 4/1994 St. Germain et al. ..... 439/376
5,337,220 * 8/1994 Granitz ..... 439/326
5,757,622 * 5/1998 Tanaka et al. ..... 439/326
5,813,878 * 9/1998 Kuwata et al. ..... 439/326
5,997,315 * 12/1999 Akama et al. ..... 439/66

* cited by examiner

*Primary Examiner*—Brian Sircus
*Assistant Examiner*—J. F. Duverne
(74) *Attorney, Agent, or Firm*—George E. Grossner; Andrew Dillon

(57) ABSTRACT

It is to provide a sub-card board connector capable of secure grounding and also easy placement and removal of a card, a sub-card board, a modem sub-card, and a computer having this connector. In sub-card board connector 1 of the present invention, (1) first GND connections 11-1, 11-2 are placed on a surface facing the sub-card board 2 of the latches 7-1, 7-2 and when connecting the sub-card board to the connector, the sub-card board is grounded by having the first GND connections contact the first electrodes provided on the sub-card board; and/or (2) second GND connections 12-1, 12-2 are placed facing the sub-card board on a surface opposite to the latches of the latch supporting parts 6-1, 6-2 and when connecting the sub-card board to the connector, the sub-card board is grounded by having the second GND connections contact the second electrodes provided on the sub-card board. And this connector is incorporated in a computer.

13 Claims, 4 Drawing Sheets

SUB-CARD BOARD CONNECTOR, SUB-CARD BOARD, MODEM SUB-CARD, AND A COMPUTER HAVING THIS CONNECTOR

BACKGROUND OF THE INVENTION

1. Technical Field

This invention relates to a connector formed on a main-card board for connecting to the main-card board in a replaceable manner a sub-card board having various functions, particularly a sub-card board connector wherein a grounding method between a connector and a sub-card board has been improved, a sub-card board, a modem sub-card, and a computer having this connector.

2. Description of the Related Art

In recent years, along with the dramatic diffusion of the Internet and that of portable telephones in addition, mounting a modem function and so on a PC has become inevitable. In particular, this modem function is one of the most important functions for a super-slim notebook PC of superior portability. Incidentally, to connect a sub-card board having such various functions to a main-card board, it is necessary, especially for a sub-card board emitting an electromagnetic wave such as a modem function, to securely ground the sub-card board in order to control electrical noise. Also, a modem needs to be certified in each individual country to which it is shipped, and to facilitate such certification, it is necessary to make the sub-card board replaceable. Moreover, it is required that the sub-card board is easily removable for upgrading and maintenance of the modem's functions.

FIG. 6 is a diagram showing an example of connecting a conventional sub-card board to a main-card board via a connector. In FIG. 6, 51 is a cover, 52 is a main-card board, 53 is a sub-card board such as a modem, and 54-1 and 54-2 are connectors, namely 54-1 is a connector fixed on the main-card board 52 side, 54-2 is a connector fixed on the sub-card board 53 side, 55 is a screw, and 56 is a stud. As FIG. 6 shows, conventionally, in the event of connecting sub-card board 53 to main-card board 52 via connectors 54-1 and 54-2, sub-card board 53 was connected to main-card board 52 by using straight-type or right-angle-type connectors 54-1 and 54-2 to be fixed with screws 55 at a few locations. And the grounding of sub-card board 53 to main-card board 52 and cover 51 was performed by using screws. Thus, while it had a sufficient grounding function, a space for screwing became necessary or it took time for placement and removal of sub-card board 53, which was a factor of increasing repair and assembly costs.

As a connector for solving the above-mentioned problem, a connector mainly used for a memory card is known. This connector is a connector formed on a main-card board for connecting to the main-card board in a replaceable manner a sub-card board having various functions, the connector comprising a connector body having an electrode pattern in contact with a terminal formed on an end face of the sub-card board; and latch supporting parts having latches from the connector body along the main-card board for setting the sub-card board on the connector body obliquely to the main-card board and, from that state, fixing the sub-card board by suppressing the reaction force in pressing the sub-card board against the connector board so that it should be along the board.

The basic structure of this connector is the same as the embodiment of the present invention explained later as FIG. 1 and FIG. 2. As for the connector of the above-mentioned structure, placement and removal of a sub-card board are simple, and the occupied space can also be made smaller since it is not fixed by screws. However, there was a problem that, while it was conventionally well grounded by using screws, a ground with screws cannot be used since there is no screw. Here, there was a problem that, if grounded with a connector terminal, the wiring used on the terminal is too thin to be sufficient and also the number of the usable terminals is limited accordingly. In addition, there was a demand for grounding around a sub-card board to eliminate radio disturbance such as EMI. Thus, it has been desired that a structure allowing good grounding be also found in this type of connectors.

SUMMARY OF THE INVENTION

An object of the present invention is to solve the above-mentioned problem and provide a sub-card board connector capable of secure grounding and also easy placement and removal of a card, a sub-card board, a modem sub-card, and a computer having this connector.

The subject of the sub-card board connector of the present invention is a connector formed on a main-card board for connecting to the main-card board in a replaceable manner a sub-card board having various functions, the connector comprising: a connector body having an electrode pattern in contact with a terminal formed on an end face of the sub-card board; and latch supporting parts having latches from both ends of the connector body along the main-card board for setting the sub-card board on the connector body obliquely to the main-card board and, from that state, fixing the sub-card board by suppressing the reaction force in pressing the sub-card board against the main-card board so that it should be along the board. In such a connector, (1) first GND connections are placed on a surface facing the sub-card board of the latches and when connecting the sub-card board to the connector, the sub-card board is grounded by having the first GND connections contact electrodes provided on the sub-card board; and/or (2) second GND connections are placed facing the sub-card board on a surface opposite to the latches of the latch supporting parts and when connecting the sub-card board to the connector, the sub-card board is grounded by having the second GND connections contact electrodes provided on the sub-card board.

Also, the sub-card board of the present invention is used for connecting with a connector of the above-mentioned structure, and in a state of the sub-card board placed on the connector, it has a first electrode provided in a position to contact first GND connections of the connector and/or a second electrode provided in a position to contact second GND connections. In addition, a modem sub-card of the present invention comprises a sub-card board of the above-mentioned structure consisting of a card having a modem function. Furthermore, a computer of the present invention has a connector of the above-mentioned structure for connecting a sub-card board.

In the present invention, it is possible to establish a good ground in a connector when a sub-card board is placed on a connector since a ground can be established either on the topside and/or on the underside of the perimeter of the sub-card board (1) by first GND connections provided on a latch and/or (2) by second GND connections provided on latch supporting parts. This part can form a large electrode due to enough space. It does not, of course, spoil the ease of placement and removal of the sub-card board that the original has.

DETAILED DESCRIPTION OF A PREFERRED EMBODIMENT

Figure 1:
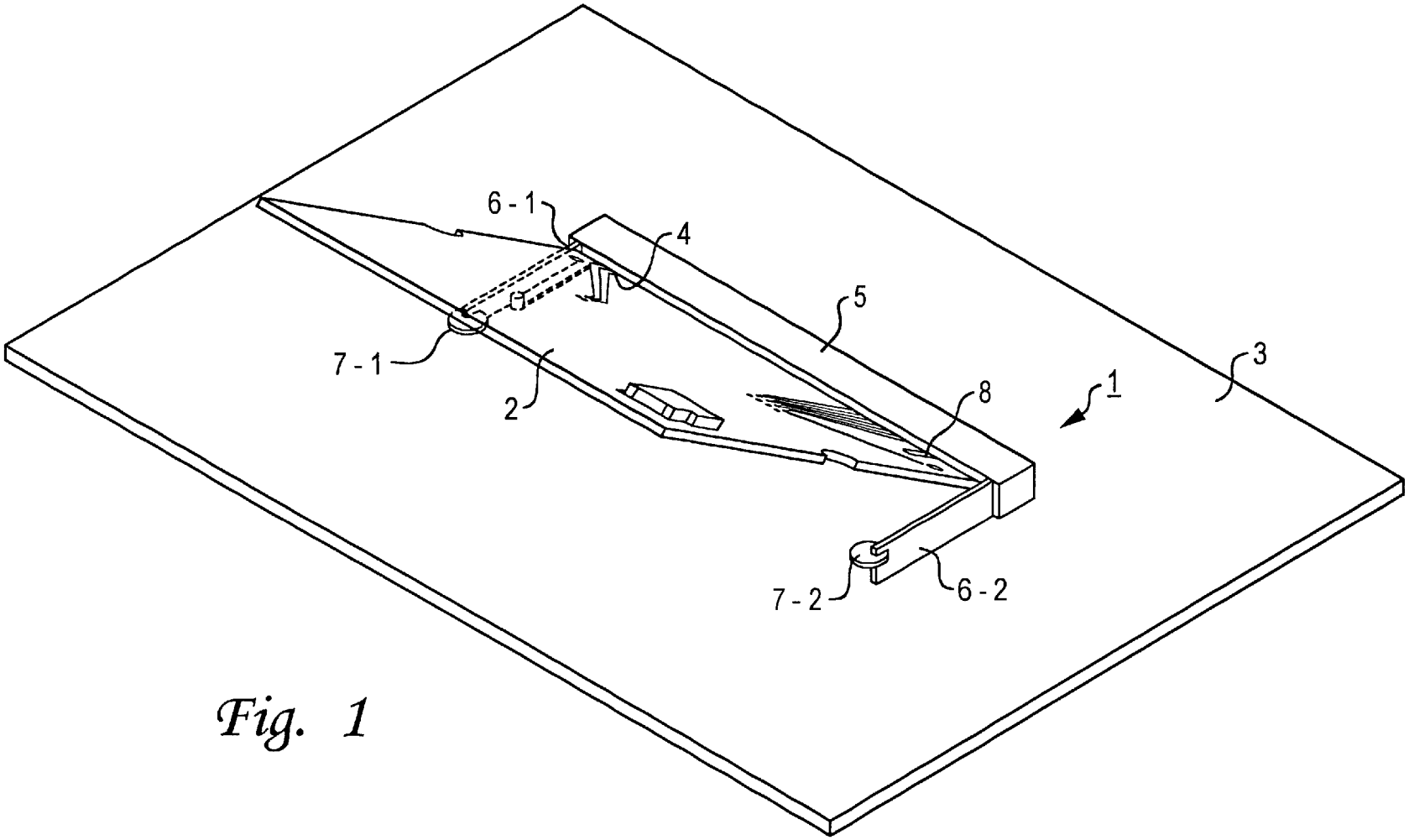
FIG. 1 is a diagram showing an example of a sub-card board connector of the present invention together with a main-card board, showing a state of a sub-card board set on a connector.
Figure 2:
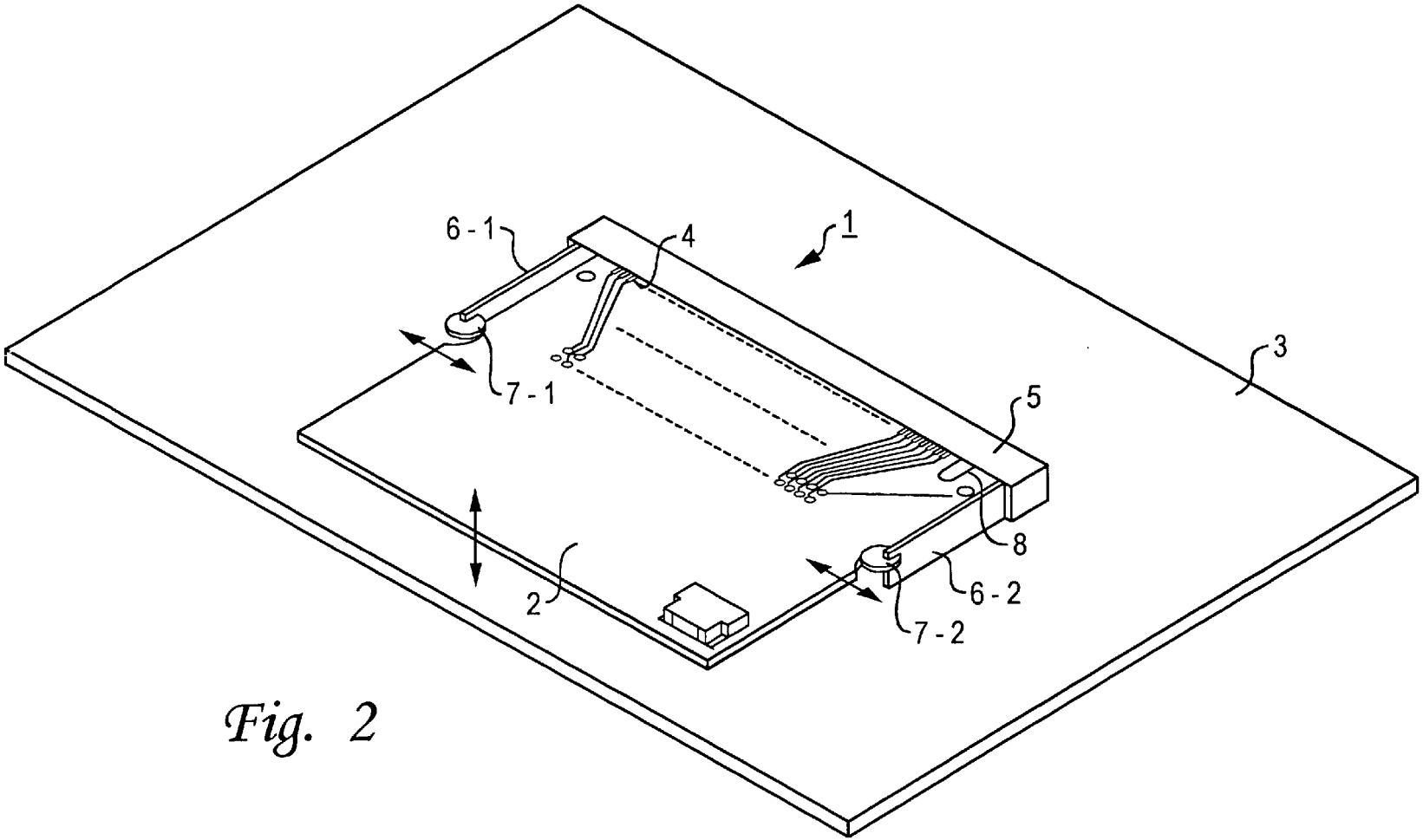
FIG. 2 is a diagram showing an example of a sub-card board connector of the present invention together with a main-card board, showing a state of a sub-card board placed on a connector.

FIG. 1 and FIG. 2 are diagrams showing an example of the structure of a sub-card board connector of the present invention, FIG. 1 showing a state before placement of a sub-card board set on a connector for connecting and FIG. 2 showing a state of a sub-card board placed on a connector respectively. In the example shown in FIG. 1 and FIG. 2, connector 1 of the present invention is for connecting to main-card board 3 in a replaceable manner sub-card board 2 having various functions such as a modem function, and is formed on a main-card board 3. Also, connector 1 comprises connector body 5 having an electrode pattern (not illustrated) connected with terminal 4 formed on one face or both faces of the topside and underside of the end face of sub-card board 2 and the two latch supporting parts 6-1, 6-2 existing from both ends of this connector body 5 along main-card board 2. Latch supporting parts 6-1, 6-2 have latches 7-1, 7-2 at their ends respectively.

To place sub-card board 2 on connector 1 of the above-mentioned structure, first, as shown in FIG. 1, sub-card board 2 should be set on connector body 5 obliquely to main-card board 3. When doing so, the edge of sub-card board 2 where terminal 4 exists should be inserted into a placement part of connector body 5 where an electrode pattern exists so as to be naturally set obliquely due to the shape of the electrode pattern. Also, when setting it, positioning is performed by engaging location notch 8 provided on the edge of sub-card board 2 with a locating lug (not illustrated) of connector body 5. However, location notch 8 is not necessarily required.

Next, from the state shown in FIG. 1, sub-card board 2 is pressed against main-card board 3 by the fingers for instance so that it should be along the main board. Since latch supporting parts 6-1, 6-2 are movable to the right and left as shown by both arrows in FIG. 2, both ends of sub-card board 2 will, by being continuously pressed, get over latches 7-1, 7-2 (latches 7-1, 7-2 then open slightly to the right and left) so that sub-card board 2 will be positioned between latches 7-1, 7-2 and main-card board 3 as shown in FIG. 2. In this state, the reaction force of the force in pressing sub-card board 2 against main-card board 3 so that it should be along the main board is suppressed by latches 7-1, 7-2, and sub-card board 2 is firmly placed on main-card board 3 via connector 1. Also, in the state of placement shown in FIG. 2, latches 7-1, 7-2 may be opened slightly to the right and left by the fingers for instance, then sub-card board 2 naturally becomes as shown in FIG. 1 and easily removable.

Figure 3:
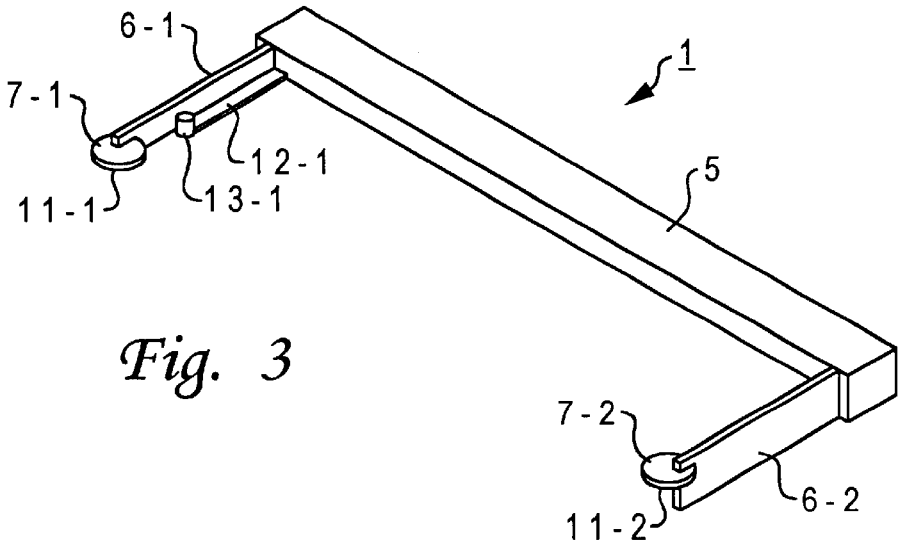
FIG. 3 is a diagram showing an example of a sub-card board connector of the present invention.

The present invention is characterized by forming first GND connections and second GND connections in the above-mentioned connector 1. Moreover, GND stands for ground and has the same meaning as earth. FIG. 3 is a diagram showing only the part of sub-card board connector 1 of the present invention. As shown in FIG. 3, the present invention is characterized by, in a state of sub-card board 2 placed on connector 1 as shown in FIG. 2, providing first GND connections 11-1, 11-2 on the surfaces of latches 7-1, 7-2 facing sub-card board 2 respectively and providing second GND connections 12-1, 12-2 in positions facing sub-card board 2 on the surfaces opposite to latches 7-1, 7-2 of latch supporting parts 6-1, 6-2 respectively. Moreover, in the example shown in FIG. 3, contact parts 13-1, 13-2 jutting from patterns to sub-card board 2 side at the ends of second GND connections 12-1, 12-2 are provided (contact part 13-2 is hidden by latch supporting part 6-2). Also, if contact parts 13-1, 13-2 are provided, contact is made at these contact parts 13-1, 13-2.

Figure 4A:
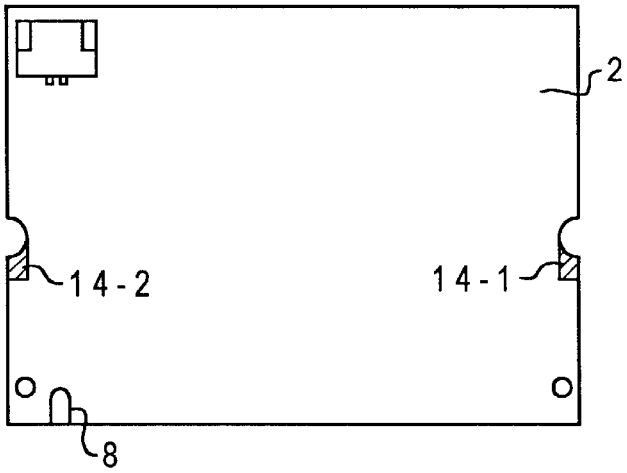
FIGS. 4(*a*) and 4(*b*) are diagrams for explaining the first GND connections and second GND connections.
Figure 4B:
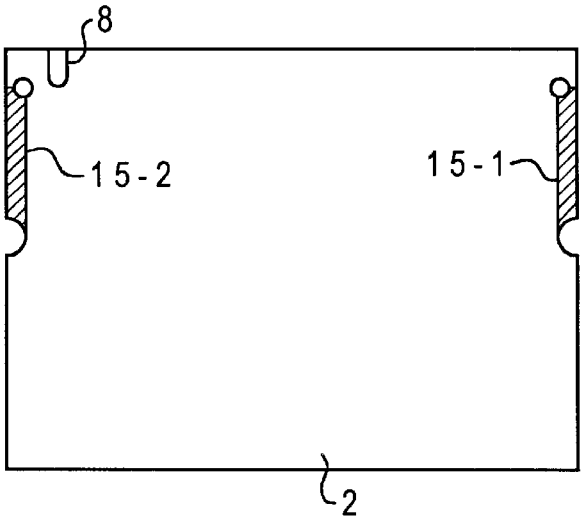

In the present invention, sub-card board 2 is grounded, in a state of sub-card board 2 connected to and placed on connector 1, by having first GND connections 11-1, 11-2 and second GND connections 12-1, 12-2 contact electrodes provided on sub-card board 2. FIGS. 4(*a*), (*b*) are diagrams showing the electrodes of sub-card board 2 in contact with first GND connections 11-1, 11-2 and second GND connections 12-1, 12-2. Namely, first electrodes 14-1, 14-2 in contact with first GND connections 11-1, 11-2 provided on latches 7-1, 7-2 are provided in positions facing first GND connections 11-1, 11-2 at both ends of the topside of sub-card board 2 as shown in FIG. 4(*a*). Also, second electrodes 15-1, 15-2 in contact with second GND connections 12-1, 12-2 provided on latch supporting parts 6-1, 6-2 are provided in positions facing second GND connections 12-1, 12-2 at both ends of the underside of sub-card board 2 as shown in FIG. 4(*b*).

Figure 5A:
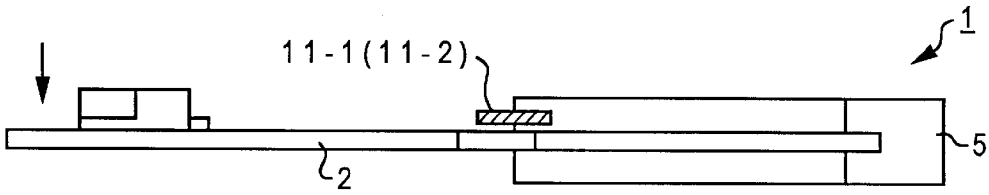
FIGS. 5(*a*) and 5(*b*) are diagrams showing an example of only the first GND connections in contact, and an example of both first GND connections and second GND connections in contact respectively.
Figure 5B:
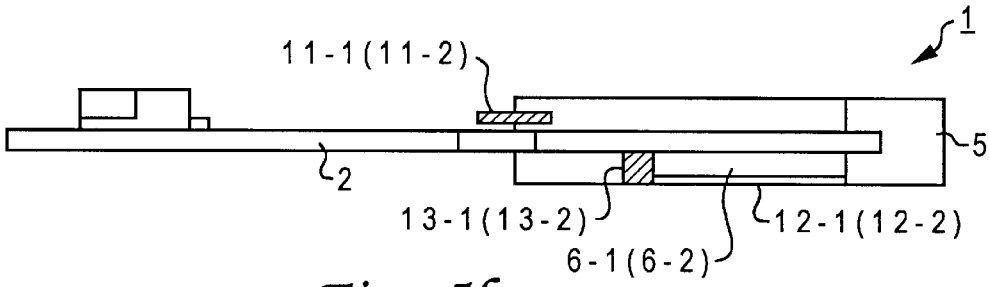
Figure 6:
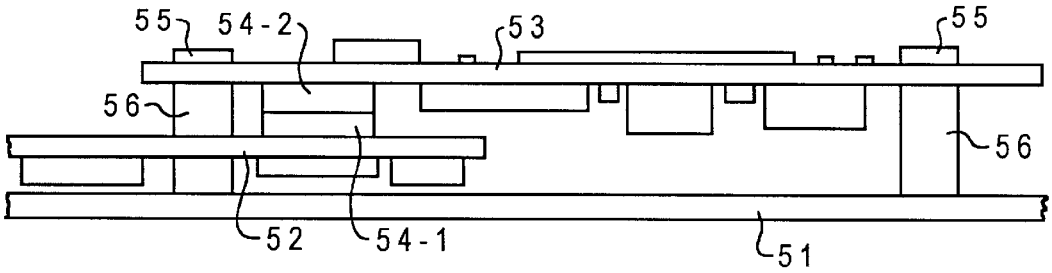
FIG. 6 is a diagram showing an example of connecting a conventional sub-card board to a main-card board via a connector.

While the above-mentioned sub-card board connector 1 of the present invention is provided with first GND connections 11-1, 11-2 and second GND connections 12-1, 12-2 so as to establish a ground on the topside and underside of sub-card board 2, needless to say, either one of them can accomplish the present invention. In the event that a subject is a thin notebook PC or the like, however, the space in the direction of its height is not enough, so the placed sub-card board 2 may shift up and down due to shifting of upper and lower parts from the predetermined positions because of electron tolerance and so on. Thus, in the event that only first GND connections 11-1, 11-2 are provided as shown in FIG. 5(*a*), and if the above-mentioned shifting occurs in the direction of the arrows, for instance, first GND connections 11-1, 11-2 and first electrodes 14-1, 14-2 may not contact. This is the same in the event that only second GND connections 12-1, 12-2 are provided, except that the direction of shifting is the opposite. In such cases, as shown in FIG. 5(*b*), it is desirable to provide both first GND connections 11-1, 11-2 and second GND connections 12-1, 12-2 as in the above-mentioned example to establish a ground by having them actively contact on the topside and underside of sub-card board 2, because contact can be made securely whether the position of sub-card board 2 may shift upward or downward.

Sub-card board 2 used for connecting with sub-card board connector 1 of the present invention is characterized by, in a state of sub-card board 2 placed on connector 1 as mentioned above, providing first electrodes 14-1, 14-2 in positions in contact with first GND connections 11-1, 11-2 and/or providing second electrodes 14-1, 14-2 in positions in contact with second GND connections 12-1, 12-2. In addition, sub-card board connector 1 of the present invention should preferably be used as a modem sub-card in particular since it can be grounded around the board to have an electromagnetic-wave-resistant structure. Moreover, sub-card board connector 1 of the present invention can also be used suitably as a connector of the mini-PCI specifications. Furthermore, a computer configured to connect a sub-card board by utilizing sub-card board connector 1 of the present invention can have a structure resistant to electromagnetic waves from connector 1 and sub-card board 2.

As it is clear from the above explanation, it is possible, by means of a sub-card board connector, a sub-card board, a modem sub-card, and a computer having this sub-card board of the present invention, to establish a good ground in a connector when a sub-card board is placed on a connector since a ground can be established either on the topside and/or on the underside of the perimeter of the sub-card board (1) because of first GND connections provided on a latch and/or (2) because of second GND connections provided on latch supporting parts. This part can form a large electrode due to enough space. It does not, of course, spoil the ease of placement and removal of the sub-card board that the original has.

What is claimed is:

1. A connector for connecting a daughterboard to a motherboard, comprising:

a connector body adapted to be mounted to a motherboard in a lateral direction;

a pair of latch supporting parts mounted to the connector body and extending from the connector body in a direction that is transverse to the lateral direction, wherein each latch supporting part is movable in the lateral direction relative to the connector body; and a pair of latches, each of which is mounted to one of the latch supporting parts, wherein each of the latches has a ground connection that is adapted to engage an electrode on a daughterboard.

2. The connector of claim 1 wherein the connector body is adapted to allow the daughterboard to obliquely engage and pivotally move relative to the motherboard.

3. The connector of claim 1 wherein the latch supporting parts are pivotally mounted to the connector body for lateral movement relative thereto.

4. The connector of claim 1 wherein the latch supporting parts are adapted to accommodate lateral shifting of the daughterboard relative to the connector body while maintaining an electrical ground connection therebetween.

5. The connector of claim 1, further comprising a second ground connection on each of the latch supporting parts, each of the second ground connections having a contact part that is adapted to engage and electrically ground a second electrode on the daughterboard.

6. An electrical assembly, comprising:

a motherboard;

a daughterboard;

a connector body mounted to the motherboard and oriented in a lateral direction;

a pair of latch supporting parts mounted to the connector body and extending from the connector body in a direction that is a transverse to the lateral direction, wherein each latch supporting part is movable in the lateral direction relative to the connector body; and a pair of latches, each of which is mounted to one of the latch supporting parts, wherein each of the latches has a ground connection for engaging an electrode on the daughterboard when the daughterboard is inserted into the connector body and moved to a grounding position.

7. The electrical assembly of claim 6 wherein the connector body allows the daughterboard to obliquely engage and pivotally move relative to the motherboard.

8. The electrical assembly of claim 6 wherein the latch supporting parts are pivotally mounted to the connector body.

9. The electrical assembly of claim 6 wherein the latch supporting parts accommodate lateral shifting of the daughterboard relative to the connector body while maintaining an electrical ground connection therebetween.

10. The electrical assembly of claim 6, further comprising a second ground connection on each of the latch supporting parts, each of the second ground connections having a contact part that engages and electrically grounds a second electrode on the daughterboard.

11. An electrical assembly, comprising:

a motherboard;

a daughterboard having a first set of electrodes on a first surface, and a second set of electrodes on a second surface that is opposite to the first surface;

a connector body mounted to the motherboard and oriented in a lateral direction;

a pair of latch supporting parts mounted adjacent to lateral ends of the connector body and extending from the connector body in a direction that is transverse to the lateral direction such that the latch supporting parts are substantially parallel to each other, wherein each latch supporting part is movable in the lateral direction relative to the connector body;

a pair of latches, each of which is mounted to one of the latch supporting parts opposite the connector body, wherein each of the latches has a first ground connection for engaging the first set of electrodes on the daughterboard;

a second ground connection on each of the latch supporting parts for engaging the second set of electrodes on the daughterboard; and wherein the latch supporting parts accommodate lateral shifting of the daughterboard relative to the connector body while maintaining grounding therebetween.

12. The electrical assembly of claim 11 wherein the connector body is allows the daughterboard to obliquely engage and pivotally move relative to the motherboard.

13. The connector of claim 11 wherein the latch supporting parts are pivotally mounted to the connector body.

* * * * *